US005372021A

United States Patent [19]

Smith

[11] Patent Number: 5,372,021

[45] Date of Patent: Dec. 13, 1994

[54] KEY CONTROL DEVICE AND METHOD THEREFOR

[75] Inventor: Jerry R. Smith, Littleton, Colo.

[73] Assignee: Ideaz International, Inc., Englewood, Colo.

[21] Appl. No.: 969,938

[22] Filed: Oct. 30, 1992

[51] Int. Cl.[5] ..... E05B 11/00

[52] U.S. Cl. ..... 70/63; 70/61; 70/389; 70/DIG. 63

[58] Field of Search ..... 70/61, 389, 390, DIG. 63, 70/460, 63, 429

[56] References Cited

U.S. PATENT DOCUMENTS

| | | | |
|---|---|---|---|
| Re. 30,198 | 1/1980 | Oliver et al. | 70/406 X |
| 2,013,027 | 9/1935 | Branch | 70/459 X |
| 2,064,474 | 12/1936 | Hopkins | 70/389 |
| 2,220,786 | 11/1940 | Grainger | 70/61 X |
| 2,336,936 | 12/1943 | Johnson | 70/61 |
| 2,762,216 | 9/1956 | Wasson | 70/63 |
| 3,292,401 | 12/1966 | Van Meter | 70/459 |
| 3,898,825 | 8/1975 | Taylor | 70/459 X |
| 3,979,934 | 9/1976 | Isenmann | 70/459 |
| 4,091,646 | 5/1978 | Sugimoto | 70/459 X |
| 4,107,967 | 8/1978 | Grabb | 70/455 X |
| 4,109,496 | 8/1978 | Allemann et al. | 70/389 X |
| 4,248,071 | 2/1981 | Kussoy | 70/459 X |
| 4,315,420 | 2/1982 | Oliver | 70/389 X |
| 4,448,051 | 5/1984 | Neilsen | 70/389 |
| 4,472,952 | 9/1984 | Hollowell, Jr. | 70/389 X |
| 4,516,776 | 5/1985 | Nicholas | 70/459 X |
| 4,567,741 | 2/1986 | Trempala | 70/389 |
| 4,753,092 | 6/1988 | Mercer | 70/389 |
| 4,942,748 | 7/1990 | McGough | 70/389 |
| 4,984,442 | 1/1991 | Benson | 70/459 X |
| 5,020,347 | 6/1991 | Logan | 70/389 |

FOREIGN PATENT DOCUMENTS

| | | | |
|---|---|---|---|
| 2045855 | 11/1980 | United Kingdom | 70/389 |

*Primary Examiner*—Lloyd A. Gall

*Attorney, Agent, or Firm*—Timothy J. Martin; Carl Schaukowitch

[57] ABSTRACT

A key control device comprises a primary key, a primary lock, a secondary key, a secondary lock, and a mechanical drive. The primary lock operably receives the primary key and is keyed such that when the primary key is inserted into the primary lock, it becomes movable between a primary key release state and a primary key capture state. The secondary lock operably receives the secondary key and is keyed such that when the secondary key is received by the secondary lock it becomes movable between a secondary key release state and a secondary key capture state. The mechanical drive interconnects the primary and secondary locks such that when the primary lock moves from its primary key release state to its primary key capture state, the secondary lock simultaneously moves from its secondary key capture state to its secondary key release state and vice versa. Only one key can be removed at any given time from either lock and such removal locks the other key against removal so that it is retained by the key control device.

27 Claims, 5 Drawing Sheets

KEY CONTROL DEVICE AND METHOD THEREFOR

FIELD OF THE INVENTION

This invention relates to access control systems for keys and other items. More particularly, this invention relates to a key control device which controls access to an item and to a method of controlling and monitoring such access among a group of persons. The system employs two interconnected locks whereby, as one key moves to its key release state, the other key moves to its key capture state and vice versa.

BACKGROUND OF THE INVENTION

Some organizations such as automobile dealerships, building maintenance firms, real estate companies and the like manage numerous locked structures. Often, this requires coordination and control over the use of many keys among many key users. To protect these keys, there have been several methods used by these organizations in an attempt to better coordinate and control the use of keys.

For example, an automobile dealership may employ a pegboard system whereby a dispatcher distributes keys to the automobile salesman upon request. There are several inherent problems with this method of key control. First, without accountability, the automobile salesman may simply forget to return the automobile keys and the dispatcher has no method of knowing who most recently took the keys. Second, if the keys are returned, the dispatcher may inadvertently place the returned automobile keys on the wrong peg. Third, even if an identification tag of the automobile salesman is placed upon the peg in exchange for the car keys, the salesman could always argue that the car keys were returned but the dispatcher failed to remove his identification tag.

Another method for the coordination and control of keys used in the automotive dealership industry as well as the real estate industry is a combination-type lock box. The lock box is either secured to the door of a home being offered for sale or the lock box is secured to the window of an automobile. Typically, these lock boxes have a door which can be removed by anyone with knowledge of the appropriate combination to gain access to the keys.

Some firms simply lock their keys in a drawer or cabinet. Anyone with a key or knowledge of the combination to that drawer or cabinet can gain access to these keys. In the building maintenance industry, many people such as the building maintenance engineers, fireman, building inspectors and others require the use of a master key. Due to the extraordinary expense of reproducing a master key of this type, only one or two keys are often shared among all of those who have a need to use it. Key coordination and control are paramount in the building maintenance industry.

In short, the major problem associated with these prior art methods of coordinating and controlling protected keys is human fallibility. Without accountability, the user of these keys has no incentive or reason to return the keys or return the same to their proper place.

Despite these systems, there remains a need for improved systems and methods for controlling access to keys and other items. These needs include a need for simple, inexpensive apparatus that eliminates intensive human monitoring. There is further a need for versatile control system that may be employed in a variety of applications without the need for special constructs dedicated to the application. It is from these considerations and others that the present invention has evolved.

SUMMARY OF THE INVENTION

It is an object of the present invention to provide a new and useful key control device and method to control the use and whereabouts of protected keys or other valuable items.

It is yet another object of the present invention to provide such a key control device and method that provides a means to determine at anytime who currently has possession of a protected key or set of keys or other valuable items.

It is yet a further object of the present invention to provide such a key control device and method that assures accountability of the user for using the protected key or set of keys or other valuable items.

A still further object of the present invention is to provide such a key control device and method whereby an unlimited number of users may employ the same without compromising the integrity or purpose of the control device and method.

Another object of the present invention is to provide such a key control device having a safer method to assure replacement of the protected keys or other valuable items in their original place after use.

Yet another object of the present invention is to provide such a key control device and method which is adaptable for either permanent installation or portable use.

Still another object of the present invention is to provide such a key control device and method which is simple to use and manufacture.

A still further object of the present invention is to provide such a key control device and method which can employ existing materials and hardware that are inexpensive to buy and easily accessible in the marketplace.

Generally, the key control device includes a primary lock having a correspondingly associated primary key. The primary lock is interconnected to a secondary lock that has a corresponding secondary key. The primary lock is adapted to operably receive the primary key and is keyed such that when the primary key is inserted into the primary lock, it becomes movable between a primary key release state and a primary key capture state. In the primary key release state, the primary key is insertable into and removable from the primary lock. In the primary key capture state, the primary key is retained by the primary lock. The secondary lock is adapted to operably receive the secondary key and is keyed such that when the secondary key is received by the secondary lock, it becomes movable between a secondary key release state and a secondary key capture state. In the secondary key release state, the secondary key is insertable into and removable from the secondary lock. In the secondary key capture state, the secondary key is retained by the secondary lock. The primary and secondary locks are interconnected in a manner such that when the primary lock moves from its primary key release state to its primary key captured state, the secondary lock moves from its secondary key capture state to its secondary key release state. Correspondingly, when the primary lock moves from its primary key captured state to its primary key release state, the secondary lock moves from its secondary key release state to its secondary key capture state.

The primary and secondary locks can be mounted to either a common support surface or different support surfaces. Preferably, a mechanical drive operatively interconnects the primary and secondary locks. The mechanical drive can include either a gear set or a cam and tie-rod arrangement. More specifically, the primary and secondary locks are of common construction each includes a cylinder plug which is rotatably disposed within a cylinder housing. The mechanical drive can interconnect the cylinder plugs of the primary and secondary locks which in turn provide relative rotation of the cylinder plugs with respect to the cylinder housings. The mechanical drive may also include cam elements mounted to the cylinder plugs of the primary and secondary locks with a tie-rod interconnecting the cam elements. In another arrangement, the mechanical drive can interconnect the cylinder plug of either the primary or secondary lock with the cylinder housing of the remaining lock. Yet in another arrangement, the primary and secondary cylinder plugs can be coaxially aligned and connected to one another for common rotation. Also, the primary and secondary cylinder plugs in coaxial alignment could be connected between the plug of one lock with the housing of the other.

The primary purposes of the control device is to control access to and use of the secondary key or to an item secured to the secondary key. It follows then that an item may be secured to the secondary key to control access to the item. Where security is paramount, the item can be secured to the secondary key by a lockable element. Further, as long as the primary key is marked with identification of the user, a plurality of primary keys may be employed to gain access to the secondary key.

These and other objects of the present invention will become more readily appreciated and understood from a consideration of the following detailed description of the preferred embodiment when taken together with the accompanying drawings, in which:

DESCRIPTION OF THE EXEMPLARY EMBODIMENTS

The present invention concerns control systems and methods for controlling and monitoring access to a key or other item. The system further concerns maintaining accountability of the individual currently having access to the controlled item where a plurality of persons are permitted access. In its broad form, the control device employs a pair of locks which are keyed to move between a key release state wherein a key may be inserted and removed and a key capture state wherein the associated key is retained. As is well known in the art of locks, locking elements such as pins are normally in first state of organization preventing manipulation of the lock and are placed in second state of organization permitting manipulation of the lock. A key is provided with a keying pattern corresponding to the lock so that, upon insertion into the keyway, the key reorganizes the locking elements from the first to the second states of organization. A lock may have one or more stations wherein the locking elements may make transition between the two states of organization, but it is most common that only one such station exists, and this may be referred to as the key release station. At any other position, the lockable elements prevent removal of the key. Accordingly, when the lock is at such a key release station, it may be said to be in a key release state since the key may be inserted and removed; at any other position, the lock may be said to be in a key capture state.

With this in mind, it may be appreciated that the locks in the present invention may each be manipulated only when their respective keys are received, and they are preset so that one lock is in the key release state, i.e., they are "out of phase." The locks are ganged together so that operation of one lock will operate the other lock provided that both keys are received in the respective locks. By being out of phase, only one key can be removed at any given time and such removal locks the other key against removal so that it is retained by the device.

Figure 1:
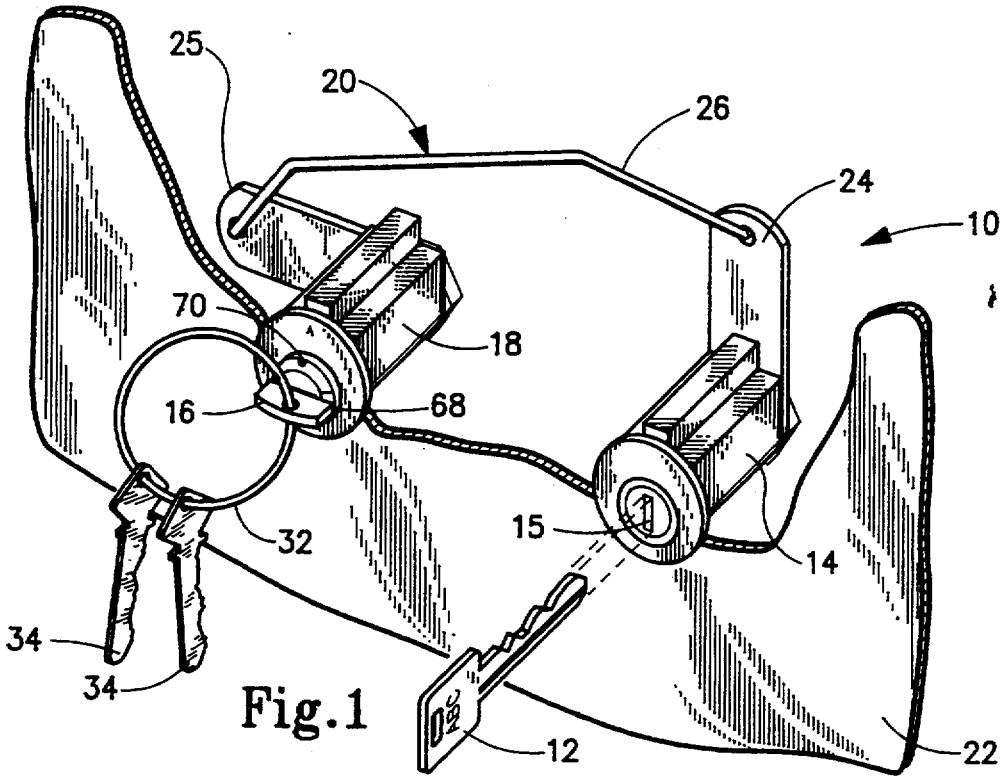
FIG. 1 is a perspective view of the key control device according to a first exemplary embodiment of the present invention showing the primary lock in the primary key release state and the secondary lock in the secondary key capture state.
Figure 2:
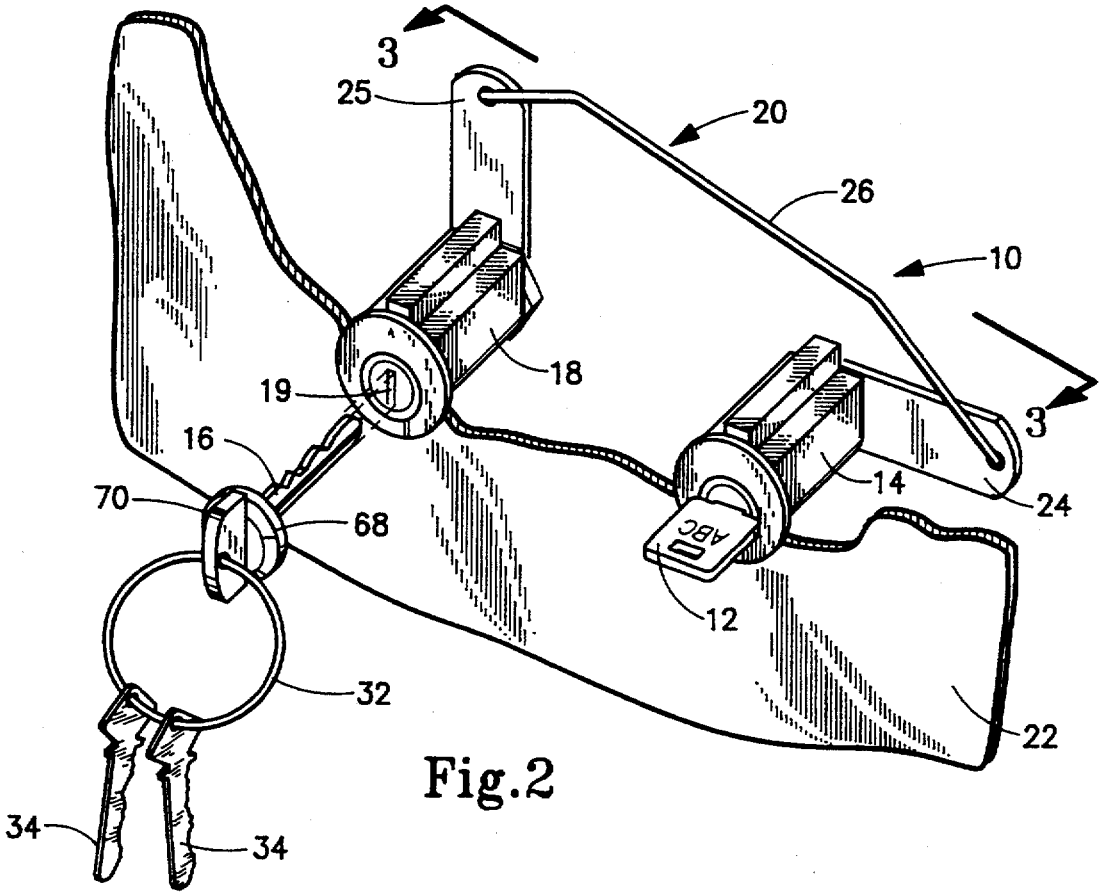
FIG. 2 is a perspective view of the key control device of FIG. 1 showing the secondary lock in the secondary key release state and the primary lock in the primary key capture state.
Figure 3:
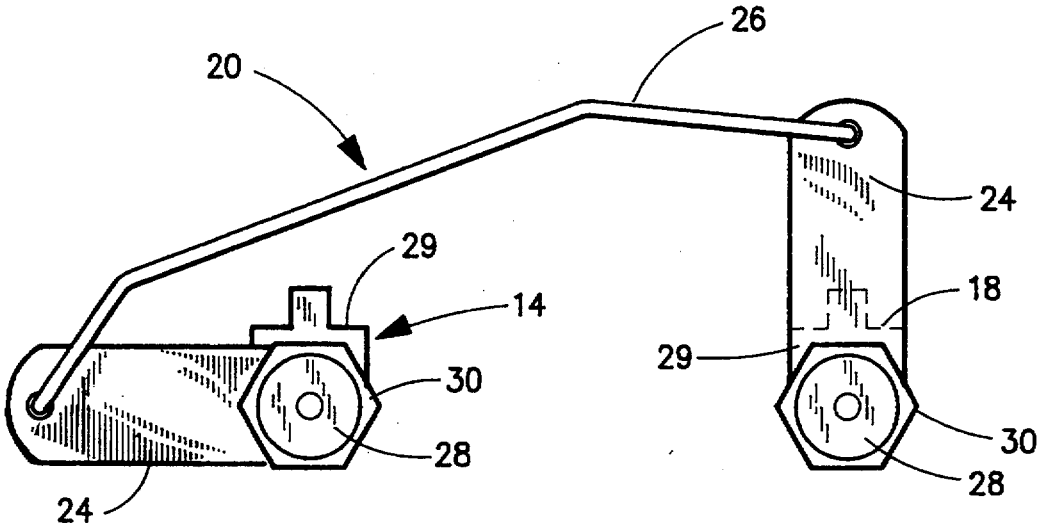
FIG. 3 is a rear elevational view of the key control device generally shown along lines 3—3 of FIG. 2.

With reference to FIGS. 1–3, then, a first exemplary embodiment of the present invention is shown in the form of a key control device 10 which includes a primary key 12, a primary lock 14, a secondary key 16, a secondary lock 18, and a mechanical drive 20. The primary and secondary locks 14 and 18 respectively are mounted to a common support structure 22 such as a metal plate, wall or similar secured mounting surface. In FIG. 1, primary lock 14 is in a primary key release state so that primary key 12 may be inserted into and removed from keyway 15. However, the secondary lock 18 is in a secondary key capture state so that secondary key 16 is retained in its respective keyway, As shown in FIG. 2, after the primary key 12 is inserted into the primary lock 14 and is moved from its primary key release state to its primary key capture state, the secondary lock 18 simultaneously moves from its secondary key capture state to its secondary key release state whereby the secondary key 16 may be removed from keyway 19 of secondary lock 18. Removal of the secondary key 16 from the secondary lock 18 causes the primary key 12 to be retained in its primary key capture state within the primary lock 14 since primary lock 14 cannot be moved to a station wherein primary key 12 is removable. This is due to the interconnection between primary lock 14 and secondary lock 18 which becomes locked upon removal of secondary key 16.

The mechanical drive 20 which operably interconnects the primary and secondary locks 14 and 18, respectively, is shown in FIGS. 1–3. In this embodiment of the present invention, the mechanical drive 20 includes a first cam element 24 and a second cam element 25 mounted to the primary and secondary locks 14 and 18, respectively, and are operably interconnected to a tie-rod 26. As with any conventional lock, each of locks 14, 18 has a cylinder plug 28 is rotatably disposed in a cylinder housing 29.

As best shown in FIG. 3, the first cam element 24 is mounted onto the cylinder plug 28 of the primary lock 14 and the second cam element 25 is mounted onto the cylinder plug 28 of the secondary lock 18. A threaded nut 30 secures the cam elements 24 and 25 onto the primary and secondary locks 14 and 18, respectively. The tie-rod 26 is pivotally mounted at each end onto each cam elements 24 and 25 in such a manner that, when the primary key 12 moves from its primary key release state to its primary key capture state, the secondary lock 18 is simultaneously moved from its secondary key capture state to its secondary key release state. Correspondingly, as the secondary lock 18 moves from its secondary key release state to its secondary key capture state, the primary lock 14 is simultaneously moved from its primary key capture state to its primary key release state. Thus, this mechanical drive 20 interconnects the cylinder plugs 28 and is operative to relatively rotate each cylinder plug 28 within its associated cylinder housing 29. With this interconnection, as the primary key 14 rotates, the secondary key 16 also rotates. It should be understood, of course, that the first cam element can be mounted onto the cylinder plug 28 of one of the locks and the second cam element can be mounted onto the cylinder housing of the other lock since it is only necessary to provide relative rotation of each cylinder plug with its respective housing. With this type of interconnection, as the primary key 14 rotates, the secondary key 16 would remain stationary.

To illustrate how the key control device 10 shown in FIGS. 1 and 2 works, its application to the automotive dealership industry has been chosen as an example. The secondary key 16 is adapted to hold a key ring 32 retaining two work keys 34. These work keys 34 may represent the ignition key and trunk key of a typical automobile. Note that the primary key 12 displays an identification code "ABC". The identification code is used to identify the salesman responsible for his/her own particular primary key. Now, for example, the automotive salesman may insert his/her primary key 12 identified as "ABC" into the primary lock 14 and move it from its primary key release state to its primary key capture state. Correspondingly, the secondary lock 18 simultaneously moves from its secondary key capture state to its secondary key release state. When the automobile salesman removes the secondary key 16 from the secondary lock 18, his/her primary key 12 identified as "ABC" remains in its primary key capture state. The only way of removing his/her primary key 12 is to return the work keys 34 to the appropriate secondary lock 18 and insert the secondary key 16 into it and move the secondary key 18 from its secondary key release state to its secondary key capture state.

Since an automobile dealership sells numerous vehicles, a plurality of these key control devices would be required and a family of primary keys would be needed for the salesmen. This family of primary keys is employed to gain access to the secondary key. Each salesman would have his/her own coded primary key 12. Therefore, all of the primary locks 14 would be keyed alike. It would also be possible for an automobile salesman to have more than one primary key 12. To avoid the likelihood of misplacing one of several secondary keys 16 into the wrong secondary lock 18 due to multiple primary keys from one salesman, each secondary lock 18 would be keyed unique. Having all of the secondary locks 18 keyed unique provides a safer method to assure replacement of the work keys 34 to their original place regardless of how many primary keys are issued to a single salesman.

From the illustration, one can easily comprehend a method of controlling keys which is inherent in the present invention. This method of controlling keys includes capturing a secondary key in a secondary locking structure, inserting a primary key into a primary locking structure associated with the locking structure and operating the primary locking structure whereby the secondary key is released from the secondary locking structure and removing the secondary key from the secondary locking structure thereby capturing the primary key within the primary locking structure. It follows that other alternative exemplary embodiments of the present invention are available to those in need of coordinating and controlling protected keys.

Figure 4:
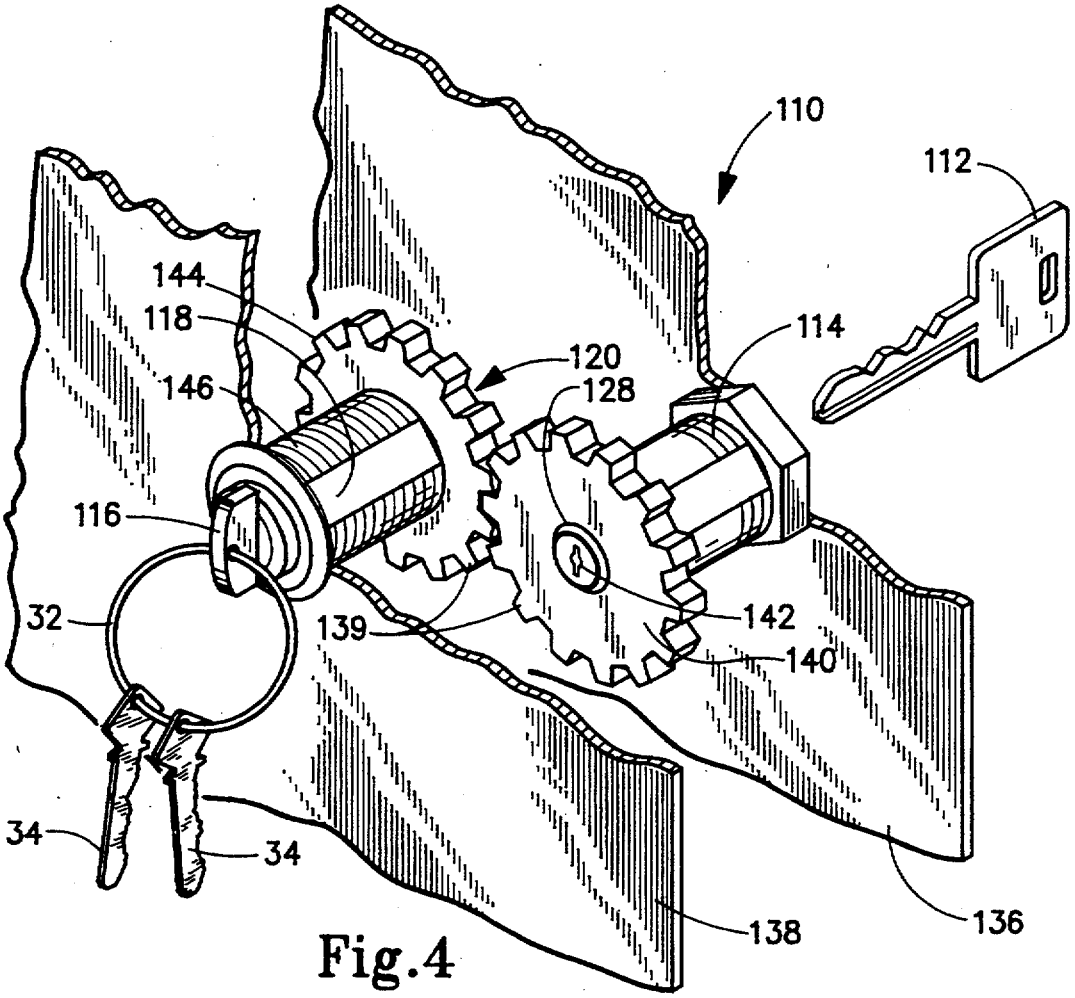
FIG. 4 a perspective view of a first alternative embodiment of the key control device according to the present invention.

A first alternative exemplary embodiment of a key control 110 of the present invention is shown in FIG. 4. Although not departing from the spirit of the invention, several differences between the preferred exemplary embodiment and this alternative exemplary embodiment are apparent. In the alternative exemplary embodiment, the primary lock 114 is mounted to a first support surface 136 while the secondary lock 118 is mounted to a second support surface 138. Another difference is that a mechanical drive 120 employs a gear set 139. A first gear 140 is mounted to the primary lock 114 by a first gear screw 142 secured into a cylinder plug 128 of the primary lock 114. A second gear 144 is securely mounted to a cylinder housing 146 of the secondary lock 118. Yet another difference is that the mechanical drive 120 interconnects the cylinder plug 128 of the primary lock 114 with the cylinder housing 146 of the secondary lock 118 and is operative to jointly rotate the cylinder plug 128 of the primary lock 114 and the cylinder housing 146 of the secondary lock 118.

There are several advantages of employing this alternative exemplary embodiment of the key control device 110. First, the gear set 139 requires less space than a cam and tie-rod arrangement. Second, unlike the preferred exemplary embodiment, interconnecting the cylinder plug 128 of the primary lock 114 with the cylinder housing 146 of the secondary lock 118 avoids any rotational movement of the secondary key 116 inserted in the secondary lock 118 while the primary key 112 moves from either its primary key release state to its primary key capture state or vice versa. Third, it might be desirable to access the primary key 112 and the secondary key 116 from separate support surfaces.

Figure 5:
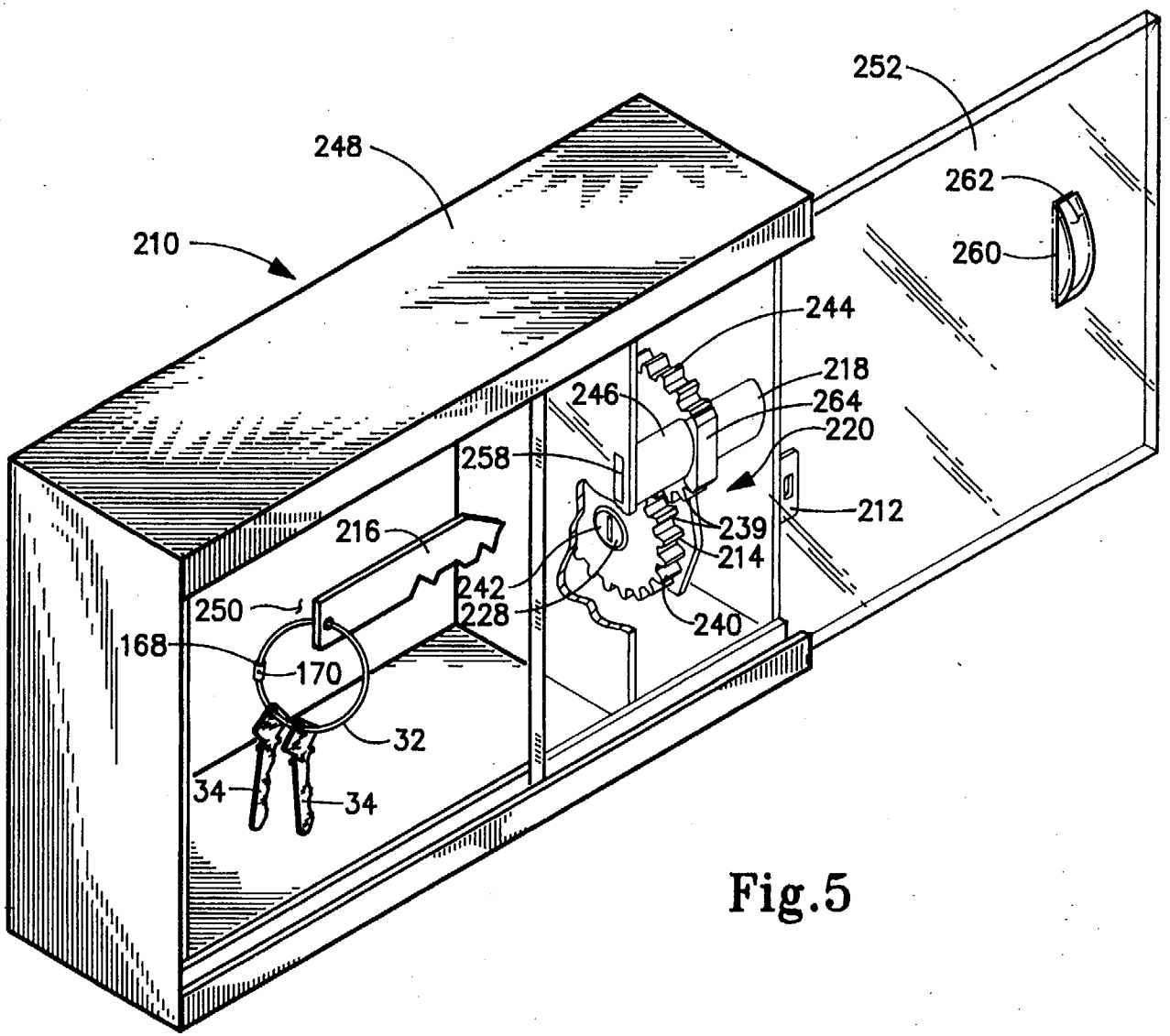
FIG. 5 is a perspective view of a control device in the form of a lock box incorporating the key control device in the embodiment shown in FIG. 4 enclosed within a housing and showing its door in an open position.
Figure 6:
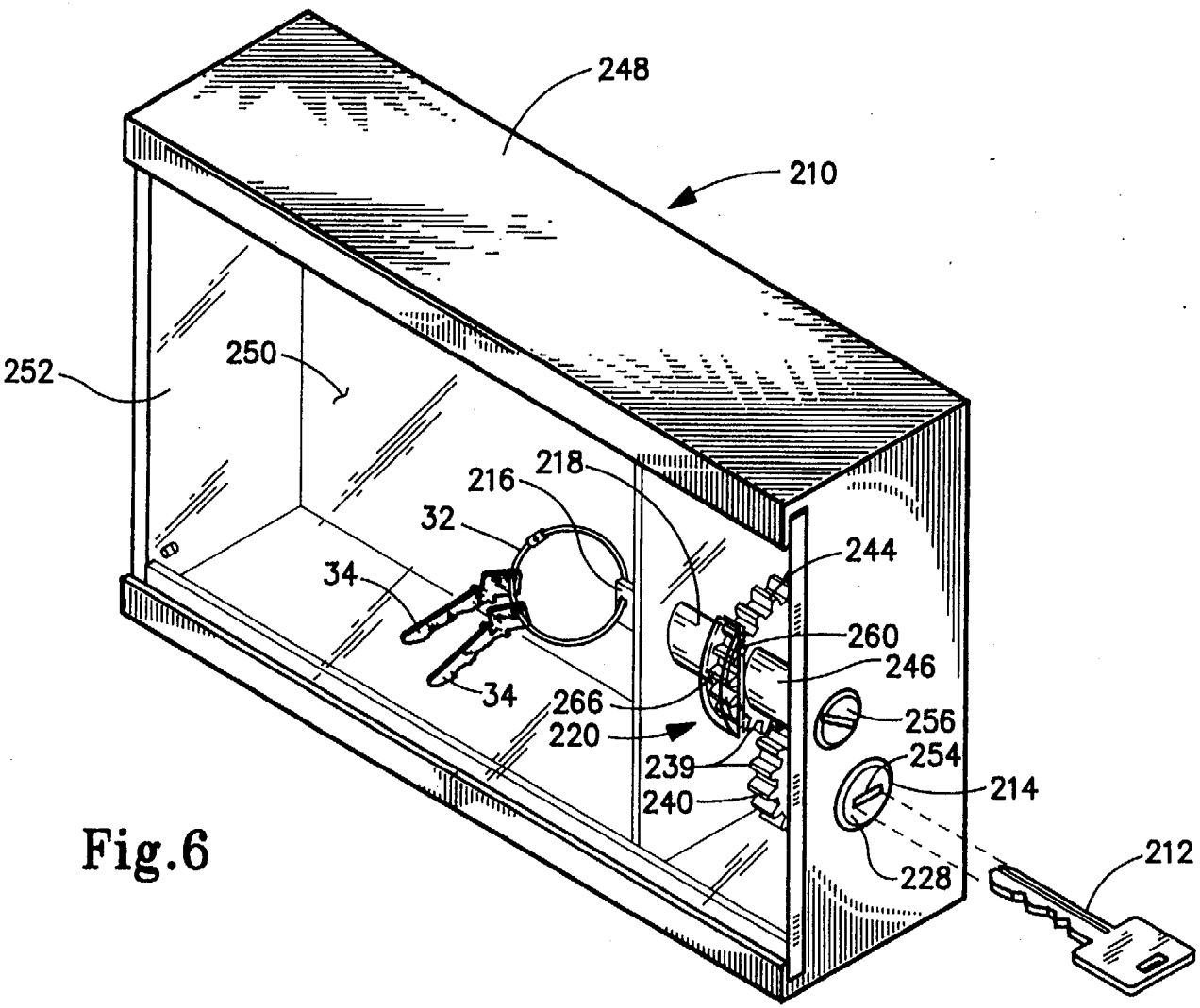
FIG. 6 is a perspective view of the key control device as shown in FIG. 5 depicting its door latched in a closed position.

A second alternative exemplary embodiment of the present invention is shown in FIGS. 5 and 6. This key control device 210 includes a housing 248 defining an enclosure having an interior 250 and including a door 252. The door 252 is shown as transparent solely for the purpose of showing the operability of the key control device 210 as a single, integrated unit. In FIG. 5, the door 252 is movable between an open position and allowing access to the interior 250 of the housing 248. In FIG. 6, the door 252 is shown in a closed position. The key control device 210 also includes a primary key 212, a primary lock 214, a secondary key 216 and a secondary lock 218. As is best shown in FIG. 6, the primary lock 214 is mounted to the housing 248 and has a primary keyway 254 which is accessible exteriorly of the housing 248. The primary lock 214 is adapted to operably receive the primary key 212 in the primary keyway 254. The primary lock 214 is keyed such that when the primary key 212 is received in the primary lock 214, it becomes movable between a primary key release state and a primary key capture state. In the primary key release state, the primary key 212 is insertable into and removable from the primary keyway 254. In the key capture state, the primary key 212 is retained within the primary keyway 254 of the primary lock 214 . The secondary lock 218 is mounted to the housing 248 by a screw 256.

As shown in FIG. 5, the secondary lock 218 has a secondary keyway 258 which is accessible interiorly of the housing 248. The secondary lock 218 is adapted to operably receive the secondary key 216 in the secondary keyway 258 . The secondary lock 218 is keyed such that when the secondary key 216 is received within the secondary lock 218, it becomes movable between a secondary key release state and a secondary key capture state. In the secondary key release state, the secondary key 216 is insertable into and removable from the secondary keyway 258. In the secondary key capture state, the secondary key 216 is retained within the secondary keyway 258 of the secondary lock 218. The primary and secondary locks 214 and 218, respectively, are interconnected such that when the primary lock 214 moves from its primary key release state to its primary key capture state, the secondary lock 218 moves from its secondary key capture state to its secondary key release state and when the primary lock 214 moves from its primary key capture state to its primary key release state, the secondary lock 218 moves from its secondary key release state to its secondary key capture state.

A mechanical drive 220 operatively interconnects the primary and secondary locks 214 and 218, respectively. Each of the primary and secondary locks 214 and 218 includes a cylinder plug 228 rotatably disposed within a cylinder housing 246. A gear set 239 includes a first gear 240 being mounted to the primary lock 214 by a first gear screw 242 and a second gear 244 mounted to the cylinder housing 246 of the secondary lock 218. The cylinder plug 228 is rotatably disposed within the cylinder housing 246 of each of the primary and secondary locks 214 and 218. With this arrangement, the gears are operative to jointly rotate the cylinder plug 228 of the primary lock 214 and the cylinder housing 246 of the secondary lock 218.

The control device 210 includes a latch structure 260 which secures the door 252 in the closed position. The mechanical drive 220 not only interconnects the primary and secondary locks 214, 218, but also operates with the latch structure 260 to release the latch structure 260 when the primary lock 214 is moved into its primary key capture state. The door 252 then may move to its open position. The latch structure 260 includes the door 252 having a recess 262 formed into it. Either the first gear 240 or the second gear 244 has a flattened peripheral portion 264 (FIG. 5) and a rounded peripheral portion 266 (FIG. 6) so that when the latched structure 260 secures the door 252 in its closed position, the rounded peripheral portion 266 of either the first gear 240 or the second gear 244 is received by the recess 262 (FIG. 6). When the latch structure 260 releases the door 252 so that it may move into its open position, the flattened peripheral portion 264 is disposed adjacent the recess 262 so that the door 252 may move to its open position as shown in FIG. 5. When the primary key 212 is moved from its primary key release state to its primary key capture state, the mechanical drive 220 simultaneously releases the latch structure 260 so that the door 252 may move into the open position. As the primary key 212 is moved from its primary key capture state to its primary key release state, the mechanical drive 220 is simultaneously disposed so that the latch structure 260 secures the door 252 in the closed position. With this alternative exemplary embodiment, the method of controlling keys would include capturing the secondary key in an enclosure wherein releasing the secondary key provides access into the enclosure.

Figure 7:
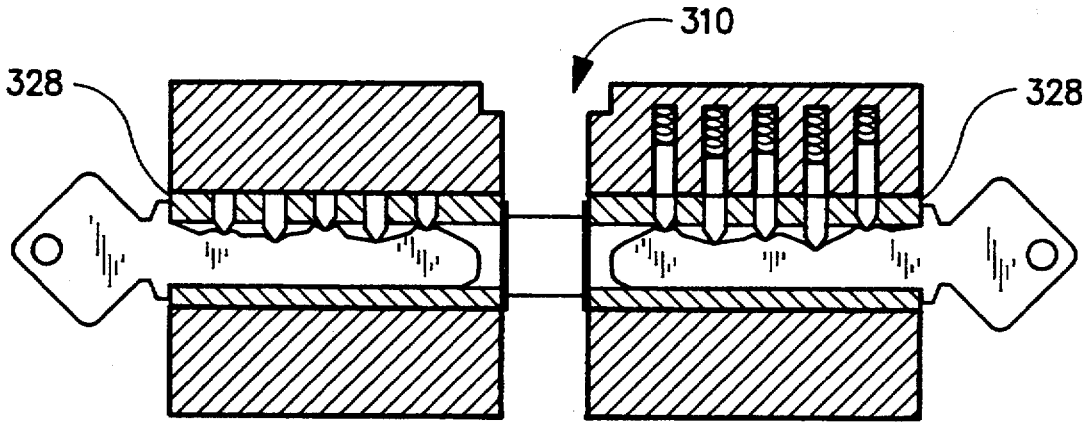
FIG. 7 is a cross-sectional view of a second alternative embodiment of the key control device shown of the present invention depicting the plugs of the primary and secondary locks coaxially aligned and connected for relative rotation.
Figure 8:
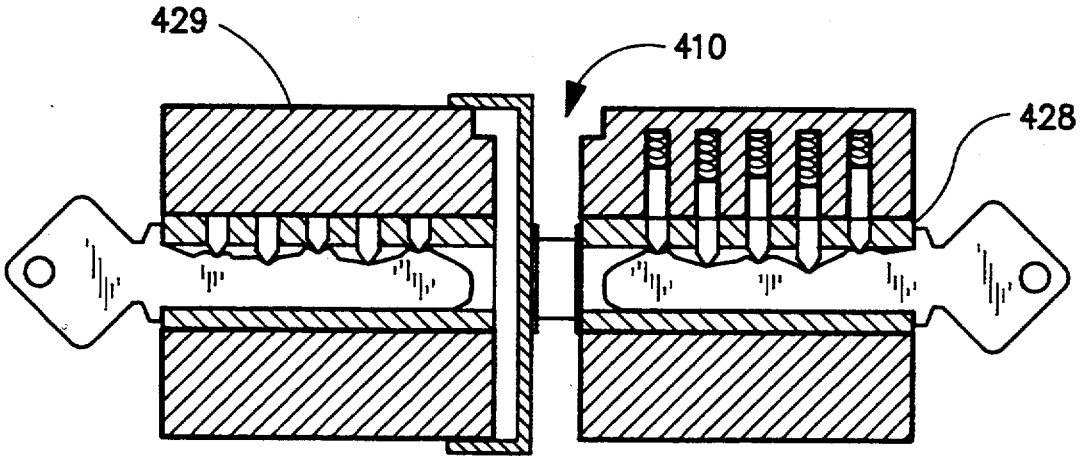
FIG. 8 is a cross-sectional view of yet another alternative embodiment of the present invention here depicting the plug of the primary lock coaxially aligned with the housing of a secondary lock and connected thereto for relative rotation.

A third and fourth alternative exemplary embodiments of key control devices 310 and 410 are shown respectively in FIGS. 7 and 8. These key control devices 310 and 410 are depicted as including conventional cylinder locks that are commonly known and used. However, other conventional locks such as wafer locks as well as others may be used to employ the present invention. Note that, as one key is disposed in its key release state, the other key is retained in its key capture state. This combination of key states is the essence of the present invention. In FIG. 7, cylinder plugs 328 of key control device 310 are coaxially aligned with each other and are ganged to one another for simultaneous joint rotation. Since one cylinder plug 328 rotates the other cylinder plug 328, both keys will also rotate along with the cylinder plugs 328. In FIG. 8, a cylinder plug 428 of one lock of key control device 410 is coaxially aligned with a cylinder housing 429 of the other lock and are connected together for simultaneous joint rotation. As the cylinder plug 428 rotates, so does the cylinder housing 429 of the other lock. As a result of this relative rotation, one key remains stationary within the lock.

As shown in FIGS. 1, 2, 4, 5 and 6, work keys 34 are shown secured to key ring 32 by way of example only. It is possible that in lieu of work keys 34 other items such as jewelry may be secured to the secondary key. Any item suitable for securing to a key ring can be protected by the present invention. Thus, the control device can be adapted to control access to an item if the item is secured to the secondary key.

Most key rings are designed so that a key can be easily secured onto or removed from the key ring. Some organizations that manage and control many keys may desire to add additional security to prevent the easy removal of the work keys or other protected items from the key ring. As a result, a lockable element 68 as shown in FIGS. 1 and 2 may be positioned onto the key and secured to the key by fastening a small set screw 70 matably engaged with lockable element 68 onto the key. In FIG. 5, an alternative embodiment of the lockable element 168 is attached to the key ring 32. This lockable element 168 is a cylinder having a longitudinally extending hole that receives two mating ends of the key ring 32. A set screw 170 secures lockable element to the key ring. As a result, the method of controlling keys includes securing an item to the secondary key.

As a result of the present invention, a new and useful control device and method control the use and whereabouts of protected keys and other valuable items and impose accountability on the users. The present invention enables a person to determine at anytime who currently has possession of a protected key or set of keys or other valuable items. With employing an identification code onto the primary key, accountability of the user is now assured for using the protected keys or set of keys or other valuable items. Since all of the primary keys are keyed alike, an unlimited number of users may use the key control device without compromising the integrity or purpose of it. With all of the secondary locks being keyed unique, there is no chance that any secondary key can be moved from its key release state to its key capture state in the wrong secondary lock regardless of how may primary keys are issued to a single user. Further, while the present inventions describe mechanical interconnections of the primary and secondary locks, it is conceivable and within the scope of this invention that the locks could be motor driven and the interconnection accomplished by switched electrical signals operating the motor drives to move the locks between the key release and key capture states.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A control device, comprising:

(a) a housing defining an enclosure having an interior and including a door movable between an open position allowing access to the interior and a closed position;

(b) a primary key;

(c) a primary lock mounted to said housing and having a primary keyway accessible exteriorly of said housing, said primary lock adapted to operably receive said primary key in the primary keyway thereof and keyed such that, when said primary key is received therein, said primary lock becomes movable between a primary key release state wherein said primary key is insertable into and removable from the primary keyway and a primary key capture state wherein said primary key is retained within the primary keyway of said primary lock;

(d) a secondary key;

(e) a secondary lock mounted to said housing and having a secondary keyway accessible interiorly of said housing, said secondary lock adapted to operably receive said secondary key in the secondary keyway thereof and keyed such that, when said secondary key is received therein, said secondary lock becomes movable between a secondary key release state wherein said secondary key is insertable into and removable from the secondary keyway and a secondary key capture state wherein said secondary key is retained within the secondary keyway of said secondary lock, said primary and secondary locks being interconnected such that when said primary lock moves from said primary key release state to said primary key capture state, said secondary lock moves from said secondary key capture state to said secondary key release state and when said primary lock moves from said primary key capture state to said primary key release state, said secondary lock moves from said secondary key release state to said secondary key capure state;

(f) a mechanical dirve operatively interconnecting said primary and secondary locks; and (g) a latch structure for securing and releasing said door from the closed position, said latch structure responsive to movement of said primary lock into the primary key capture state to release said door from the closed position so that said door may move to the open position and responsive to movement of said primary lock into the primary key release state to secure said door in the closed position.

2. A control device according to claim 1 wherein said latch structure is operated by said mechanical drive.

3. A control device according to claim 2 wherein as said primary lock is moved into said primary key capture state, said mechanical drive simultaneously releases said latch structure so that said door may move to the open position and as said primary lock is moved into said primary key release state, said mechanical drive simultaneously disposes said latch structure for securing said door in the closed position.

4. A control device according to claim 3 wherein each of said locks includes a cylinder plug rotatably disposed within a cylinder housing and said mechanical drive includes a gear set having at least two gears.

5. A control device according to claim 4 wherein at least a first gear is mounted to said cylinder plug of a first one of said primary and secondary locks and at least a second gear is mounted to said cylinder housing of a second one of said primary and secondary locks, said gears operative to relatively rotate said first cylinder plug and said second cylinder housing.

6. A control device according to claim 4 wherein said latch structure includes said door having a recess and wherein one of said gears has a flattened peripheral portion and a rounded peripheral portion whereby when said latch structure secures said door in the closed position, said rounded peripheral portion of said gear is received by said recess and when said latch structure releases said door so that said door may move to said open position, said flattened peripheral portion is disposed adjacent said recess so that said door may move to said open position.

7. A control device according to claim 2 wherein said latch structure is defined by a portion of said mechanical drive.

8. A control device according to claim 2 wherein as said primary lock is moved into said primary key capture state, said mechanical drive simultaneously releases said latch structure so that said door may move to the open position and as said primary lock is moved into said primary key release state, said mechanical drive simultaneously disposes said latch structure for securing said door in the closed position.

9. A control device according to claim 8 wherein each of said locks includes a cylinder plug rotatably disposed within a cylinder housing and said mechanical drive includes a gear set having at least two gears.

10. A control device according to claim 9 wherein at least a first gear is mounted to said cylinder plug of a first one of said primary and secondary locks and at least a second gear is mounted to said cylinder housing of a second one of said primary and secondary locks, said gears operative to jointly rotate said cylinder plug and said cylinder housing.

11. A control device according to claim 9 wherein said latch structure includes said door having a recess and wherein one of said gears has a flattened peripheral portion and a rounded peripheral portion whereby when said latch structure secures said door in the closed position, said rounded peripheral portion of said gear is received by said recess and when said latch structure releases said door so that said door may move to said open position, said flattened peripheral portion is disposed adjacent said recess so that said door may move to said open position.

12. A control device according to claim 2 wherein said primary and secondary locks each includes a cylinder plug rotatably disposed within a cylinder housing.

13. A control device according to claim 12 wherein said mechanical drive interconnects the cylinder plugs and is operative to jointly rotate each said cylinder plug with respect to its associated said cylinder housing.

14. A control device according to claim 13 wherein said mechanical drive includes cam elements mounted to said cylinder plugs and a tie-rod interconnecting said cam elements.

15. A control device according to claim 12 wherein said mechanical drive interconnects the cylinder plug of a first one of said primary and secondary locks with the cylinder housing of a second one of said primary and secondary locks and is operative to relatively rotate each said cylinder plug with respect to its cylinder housing.

16. A control device according to claim 15 wherein said mechanical drive includes a first cam element mounted on the cylinder plug of said first one of said primary and secondary locks and a second cam element mounted on the cylinder housing of said second one of said primary and secondary locks and a tie-rod interconnecting said first and second cam elements.

17. A control device according to claim 12 wherein said primary and secondary cylinder plugs are coaxially aligned and connected to one another for common rotation.

18. A control device according to claim 2 adapted to control access to an item wherein said item is secured to said secondary key.

19. A control device according to claim 18 wherein said item is secured to said secondary key by a lockable element.

20. A control device, comprising:

(a) a primary key;

(b) a primary lock including a primary cylinder plug rotatably disposed within a primary cylinder housing that is stationarily mounted with respect to a support, said primary cylinder plug adapted to operably receive said primary key and keyed such that, when said primary key is received therein, said primary cylinder plug may be rotated whereby said primary lock moves between a primary key release state wherein said primary key is insertable into and removable from said primary lock and a primary key capture state, wherein said primary key is retained by said primary lock;

(c) a secondary key; and (d) a secondary lock including a secondary cylinder plug rotatably disposed within a secondary cylinder housing, said secondary cylinder plug stationarily mounted with respect to said support and adapted to operably receive said secondary key and keyed such that, when said secondary key is received therein, said secondary cylinder housing may be rotated whereby said secondary lock moves between a secondary key release state wherein said secondary key is insertable into and removable from said secondary lock and a secondary key capture state wherein said secondary key is retained by said secondary lock, the primary cylinder plug being interconnected with the secondary cylinder housing such that, rotation of said primary cylinder plug operatively rotates said secondary cylinder housing with said secondary key remaining stationary with respect to said support.

21. A control device according to claim 20 wherein said primary and secondary locks are each mounted to a support surface.

22. A control device according to claim 21 wherein a pair of support surfaces are provided by a common support structure.

23. A control device according to claim 21 including a mechanical drive operatively interconnecting said primary and secondary locks.

24. A control device according to claim 23 wherein said mechanical drive includes a gear set.

25. A control device according to claim 20 including a mechanical drive operatively interconnecting said primary and secondary locks.

26. A control device according to claim 25 wherein said mechanical drive includes a first cam element mounted on the cylinder plug of a first one of said primary and secondary locks and a second cam element mounted on the cylinder housing of a second one of said primary and secondary locks and a tie-rod interconnecting said first and second cam elements.

27. A control device according to claim 20 adapted to control access to an item wherein said item is secured to said secondary key.

* * * * *